United States Patent [19]

Voituriez et al.

[11] 3,963,128

[45] June 15, 1976

[54] CHARGING DEVICE FOR A BLAST-FURNACE

[75] Inventors: Henry Voituriez, Dunkerque; Rene Aymard, Grande Synthe, both of France

[73] Assignee: Union Siserugique du Nord et de l'Est de la France, Paris, France

[22] Filed: Jan. 13, 1975

[21] Appl. No.: 540,424

[30] Foreign Application Priority Data

Jan. 14, 1974 France.....74.01159

[52] U.S. Cl...... 214/35 R; 193/3

[51] Int. Cl.[2]..... F27B 11/12

[58] Field of Search..... 214/35 R, 37, 17 CB; 239/665; 193/3, 2, 16; 266/27

[56] References Cited

UNITED STATES PATENTS

| | | | |
|---|---|---|---|
| 3,261,345 | 7/1966 | Tuck | 214/35 R |
| 3,693,812 | 9/1972 | Mahr et al. | 214/35 R |
| 3,921,831 | 11/1975 | Takahashi et al. | 214/35 R |

*Primary Examiner*—Robert G. Sheridan

*Attorney, Agent, or Firm*—Burns, Doane, Swecker & Mathis

[57] ABSTRACT

The charging device for a blast-furnace is so constructed as to be lighter, smaller in overall size and cheaper than known devices. It is also more reliable and requires substantially less maintenance while it enables the charge distribution to be regulated.

It comprises a rotating spout disposed in the blast-furnace and suspended from a tubular shaft. The spout carries a nose which is orientable in a vertical plane and has an actuating rod wich is mounted with a sealed joint to extend through the shaft. The drive and guide devices for this assembly are located outside the blast-furnace. The charge is fed to the device by two bins having a vertical axis so that there is less risk of the charge becoming excessively packed or jammed in the region of the discharge hoppers controlled by a shutter or like mechanism.

5 Claims, 4 Drawing Figures

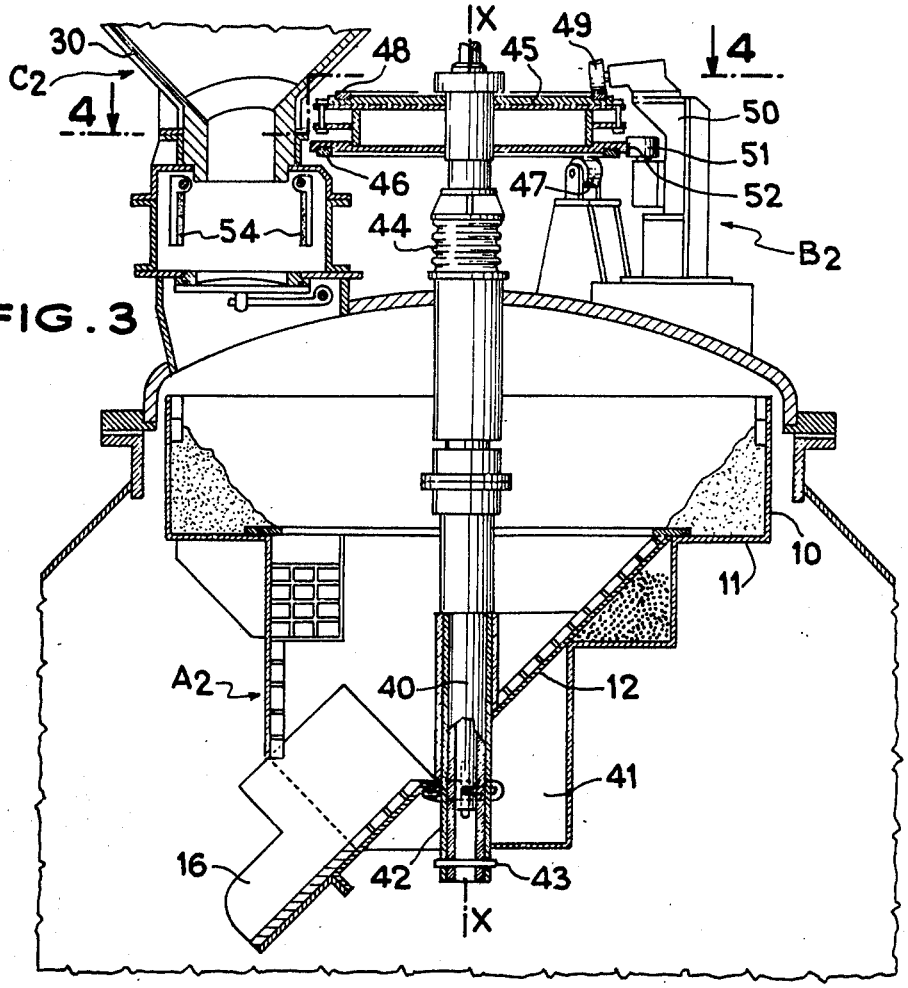
FIG. 3
FIG. 4
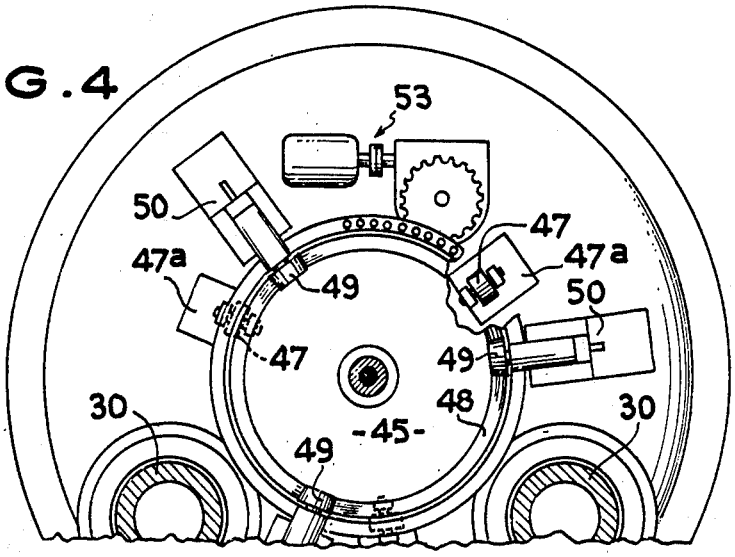

CHARGING DEVICE FOR A BLAST-FURNACE

The present invention relates to mouths of blast-furnaces that it to say to devices for charging these plants.

Various blast-furnace charging systems are know and in particular a conventional double-bell system comprising a small bell and a large bell defining therebetween a lock chamber, the upper or small bell being located in the lower part of a bin or hopper which is fed by a skip car, belt conveyor or the like, and the lower or large bell being directly disposed in the upper part of the blast-furnace. Such an arrangement possesses at the present time serious drawbacks the main drawbacks of which are the following:

a. Owing to the high counter-pressures prevailing in modern blast-furnaces the sealing is difficult to achieve in particular in the region of the large bell which is of very large diameter.

b. It concerns a very heavy system requiring very strong supporting superstructures and it must be controlled by means of complex and costly hydraulic devices. Also the investments required for the construction and maintenance of such devices are very high.

c. Owing to the complexity of the system, when parts must be changed or repairs must be carried out the blast-furnace must lie idle for costly long periods which is also a great loss.

In another charging device there is provided in the upper part of the blast-furnace a spout or chute which undergoes two movements: a movement of rotation about a vertical axis and a swinging movement about a horizontal axis. This chute is fed by two lock chambers provided with valves. This constructional arrangement is lighter than the aforementioned system but also has serious drawbacks, the main drawbacks of which are the following:

a. The chute is made to undergo the double movement by means of a complicated mechanism also located in the blast-furnace where it is therefore exposed to the harmful actions of the dust and temperature with the risk of possible faulty operation and/or a rapid wear of the various parts.

b. Owing to the position of the mechanism and of the chute inside the blast-furnace, when repairing or carrying out maintenance work access thereto is particularily difficult and even dangerous.

c. The lock chambers feeding the chute must have in their lower part inclined chutes which are closed by valves, this inclination having for effect to increase the risk of excessive packing or jamming of the charge in the region of the lower sealed valve.

Bearing in mind the aforementioned prior art, it is an object of the present invention to provide a blast-furnace charging device or throat which is lighter and cheaper in construction than the prior devices and has a substantially higher operational reliability. Moreover, this device must permit the obtainment of a very even and regulatable distribution of the charge.

According to the invention, there is provided a charging device of the type comprising a rotatable spout disposed in the upper part of the blast-furnace, wherein the spout is suspended from a vertical tubular shaft mounted with a sealed joint, to extend through the dome of the blast-furnace and supported by a frame integral with the blast-furnace, the means for guiding, driving and controlling this shaft being disposed outside the blast-furnace and the spout comprising a nose which is orientable in a substantially vertical plane and a rod for actuating the nose which extends, with a sealed joint, through the shaft suspending the spout.

In order to achieve a regulatable distribution of the charge, there may also be provided means for varying the speed of rotation of the spout so as to modify the path of the charge inside the blast-furnace.

In a preferred embodiment, the shaft is mounted on the fixed frame by at least one axial thrust bearing and at least two radial bearings.

Two embodiments of the invention will now be described in more detail. This description will be made with reference to the accompanying drawings in which:

FIG. 3 is a vertical sectional view of a second embodiment of a device according to the invention, and FIG. 4 is a sectional view taken on line 4—4 of FIG. 3.

Figure 1:
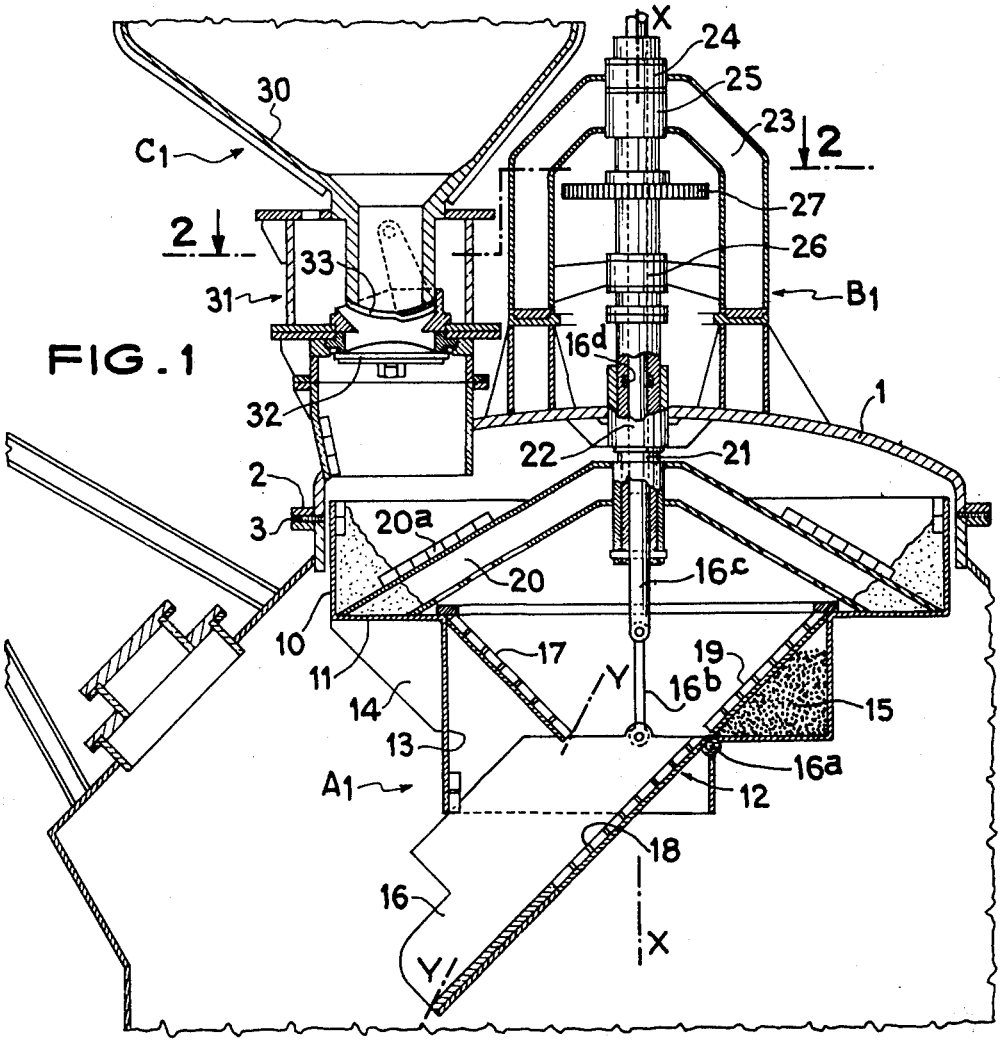
FIG. 1 is a vertical sectional view of a charging device according to the invention.

FIG. 1 shows a charging device or throat for a blast-furnace, only the upper part of the latter being shown in the drawing and terminating in a dome 1 which has a flange 2 and is fixed by known means with interposition of a seal 3 of known type which will not be described here.

The charging device proper comprised three subassemblies which will be dexcribed in turn, namely: a spout $A_1$, support and drive means $B_1$ and feeding means generally indicated by the reference $C_1$.

The spout $A_1$, disposed inside the blast-furnace, comprises a substantially cylindrical upper part 10 whose diameter is slightly less than the diameter of the dome of the blast-furnace. This cylindrical part 10 is substantially centered on the axis X—X of the blast-furnace. It is integral with a planar ring 11 and with a frustoconical intermediate part 12 whose axis Y—Y is inclined, a generatrix 13 of this intermediate part being vertical. There are provided stiffening gussets 14 and ballast 15 for balancing the out of balance due to the presence of the nose 16 of the spout at the lower end of the fructonconical part. This nose 16 is mounted on the spout to pivot about a substantially horizontal axis 16*a* and is suspended through a link 16*b* from an actuating rod 16*c* slidably mounted in a shaft 21 which will be described hereinafter. Seals 16*d* afford a sealed joint between the rod 16*c* and the shaft 21. The rod 16*c* may be controlled or shifted by any suitable means (not shown).

There is provided adjacent the vertical generatrix 13, a deflector 17 adapted to deflect the charge onto, and distribute it over, the opposite wall 18 of the spout. This deflector is upwardly convex and may have an inverted V-section or a more rounded shape. It is protected by lining or facing means 17*a* of resistant material. The spout is provided with a protective ruching or bee-hive structure.

This spout assembly is suspended in the blast-furnace by the following means; at least three arms 20 covered with a wear-resistant lining or facing means 20*a* and connected to the tubular shaft 21 which extends through the dome in the region of sealing means 22 which do not need to be described in detail. The shaft 21 is suspended from a frame which mainly comprises a tripod 23 which is secured to the upper part of the dome and on which are provided, on one hand, a thrust bearing 24 and, on the other, two radial rolling bearings 25,26 which preferably have conical rollers, these bearings ensuring the vertical guiding and alignment of the shaft. This assembly affords great rigidity, an improved centering of the shaft 21 and excellent sealing durability. Maintenance costs are thus reduced.

Figure 2:
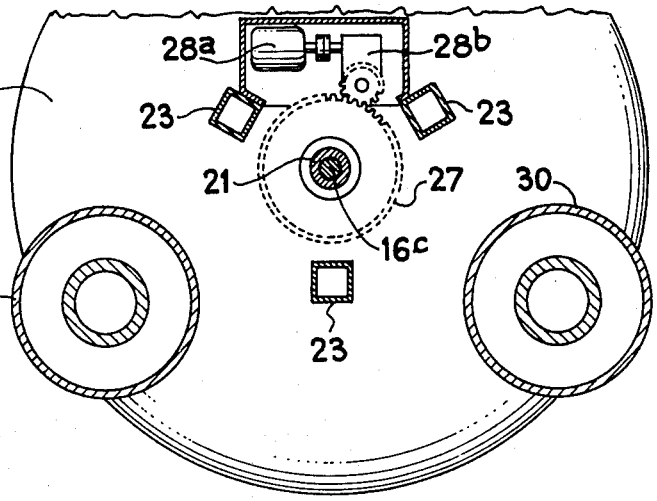
FIG. 2 is a sectional view taken on line 2—2 of FIG. 1.

A toothed wheel 27 is fixed on the shaft 21 and driven in rotation by a motor 28*a* through a speed-reducer 28*b* seen better in FIG. 2.

The spout is fed by two bins 30 which are closed in their upper and lower parts by sealing devices of conventional type comprising in the chosen example, in the upper part, a valve (not seen in the drawing) and, in the lower part 31, a gas-tight valve 32 and a shutter mechanism 33 for regulating the flow. The two feeding bins are disposed on the periphery of the dome and spout $A_1$ and are oriented vertically so that the charge has no tendency to become excessively packed or jammed in the region of the lower shutter and valve.

In the embodiment shown in FIGS. 3 and 4, the spout $A_2$ has on the whole the same construction as in the first embodiment and the same is true in a general way of the feeding device $C_2$. However, the connecting means between the nose 16 and the rod 16*c* are slightly different but achieve a similar result.

The main modification concerns the suspending and driving means $B_2$ which will therefore be described in more detail. These means mainly comprise a shaft 40 which extends downwardly to beyond the frustconical part 12 and is fixed to a reinforcing plate 41, for example by means of a tube 42 and a key 43. This arrangement ensures an improved stability of the moving part. However, it will be understood that other fixing means may be employed without departing from the scope of the present invention.

The shaft 40 also extends through the dome in which sealing means 44 are provided and in its upper part it is fixed to a driving ring 45 having pins by which ring the moving part is also supported and guided. A runway 46 bearing on supporting rollers 47 affords the support, these rollers being, for example, three in number and angularly spaced apart and disposed in the positions shown in FIG. 4. These rollers are carried by frames 47*a* secured to the dome. There is also provided an upper runway 48 which cooperates with retaining rollers 49 carried by brackets 50 secured to the dome, these brackets also supporting a set of guide rollers 51 which roll along a cylindrical runway 52 provided on the periphery of the ring 45.

The drive means comprise a motor speed reducer unit 53 whose output member rotates the ring 45 which is integral with the shaft 41.

The feeding device is constituted, as before, by two charge bins forming lock chambers and provided in their upper and lower parts with valves regulating the flow of the charge. In this embodiment, the lower device for obtaining a regulatable flow is constituted by two flaps 54 which are pivoted at diametrically opposed points and may be opened to a variable extent to regulate the section of pssage.

It is unnecessary to go into the details of operation of a charging device such as that shown in FIGS. 1 and 2 or in FIGS. 3 and 4, and only the particular features which distinguish it from prior charging devices will be mentioned.

In operation, the spout $A_1$ or $A_2$ is driven in rotation. According to the inclination of the nose 16, and possibly according to the speed of rotation of the spout, the charge, subjected to centrifugal force, is thrown at a variable distance from the axis X—X. This is an essential feature, since it is thus possible to modify the distribution of the charge. This is an important advantage over prior bell-type charging devices. It is important to note that the combination of a hollow suspension shaft and a coaxial rod for actuating the nose 16 is particularily advantageous: the actuating mechanism proper is disposed outside the blast-furnace and the seals associated with the rod are of small diameter and readily accessbile. They therefore present little or no problem as concerns maintenance.

The charge contained in the bins 30 flows vertically from the latter under the control of the operators of the blast-furnace and falls at the periphery of the rotating spout where it forms between the parts 10 and 11 a "case of stones" so that wear of the metal parts is avoided in this region. Moreover, the facing or linings 17*a* and 20*a* avoid wear of the suspension arms 20 and the upper part of the deflector 17.

Although it may be unnecessary to describe the operation of this device in detail, it is on the other hand important to stress the essential advantages it affords over known arrangment:

The device on the whole is of very simple construction so that it costs less and the necessary initial investments are lower. It is known that this cost and these investments are very high in absolute value in the care of conventional charging devices.

As it is simple in construction, its weight and overall size are also reduced, this facilitates its placement in the upper part of the blast-furnace and reduces the size of the supporting superstructures and facilitates any required dismantling and maintenance operations.

An essential advantage resides in the simplicity of the drive and control means, since the spout drive devices and the devices for regulating the inclination of the nose are very simple and wholly disposed outside the blast-furnace so that they are not exposed to very severe surrounding conditions. The reliability of the whole of the device is therefore considerably improved. Likewise the wear-resistant parts are reduced in number since they are limited to substantially only the lower valves of the charge feeding bins and the nose 16 of the spout which may, however, be designed and constructed in such manner as to be capable of resisting the stresses to which they are subjected for a very long time.

As a result of the aforementioned constructional advantages, there is considerable reduction in stoppages and inoperative periods of the blast-furnace so that the blast-furnace pays its way much better. It is also essential to note that all the parts of the assembly are perfectly accessible and that in the case of maintenance inspection or repairs, the stoppage time will always be short and the safety is increased for the furnace specialists.

There may also be mentioned among the advantages two points which were already stressed in the description of the operation, namely: the fact that the vertical feeding from bins permits avoiding any jamming of the charge whereas the adjustable orientation of the nose and the variable speed of rotation of the spout enable the distribution of the charge to be modified and improved without complicating the drive mechanism.

Having now described our invention, what we claim as new and desire to secure by Letters Patent is:

1. A charging device for a blast-furnace having a dome, comprising a frame supported by said dome outside the blast-furnace, a tubular shaft mounted with a sealed joint to extend through the dome of the blast-furnace and carried by the frame, a rotatable spout structure disposed in the upper part of the blast-furnace and suspended from said tubular shaft through suspension arms, guide, drive and control means for said tubular shaft,disposed outside the blast-furnace, the rotatable spout structure comprising an upper portion formed by a substantially cylindrical wall whose diameter is slightly less than the diameter of the dome of the blast-furnace and substantially centered on the axis of the blast-furnace, and by a substantially horizontal planar ring, a frustoconical intermediate part extending downwardly from said planar ring and having an oblique axis and a substantially vertical generatrix, a nose mounted on said intermediate frustoconical part to pivot about a substantially horizontal axis and actuated by an actuating rod slidably mounted with a sealed joint in said shaft, and a deflector located above the substantially vertical generatrix of said frustoconical part and adapted to deflect the charge onto, and distribute it over, the opposite wall of the frustoconical part of the spout, said deflector being upwardly convex and being protected by lining or facing means of resistant material, said charging device further comprising two bins for feeding the charge to the spout structure, each of said bins comprising a discharge hopper which has a substantially vertical axis and opens into the blast-furnace in the vicinity of the periphery of the upper part of the spout structure.

2. A device as claimed in claim 1, wherein the means for driving the spout structure have a variable speed.

3. A device as claimed in claim 1, wherein said shaft extends through the spout structure and is fixed to a lower portion of the frustoconical intermediate part of the spout structure.

4. A device as claimed in claim 3, comprising a tube fixed to the spout structure, said shaft extending through and being fixed to the tube.

5. A device as claimed in claim 1, wherein said shaft is supported and guided by said frame through at least one axial thrust bearing and at least two radial rolling bearings.

* * * * *

UNITED STATES PATENT OFFICE

CERTIFICATE OF CORRECTION

Patent No. 3,963,128 Dated June 15, 1976

Inventor(s) HENRY VOITURIEZ ET AL

It is certified that error appears in the above-identified patent and that said Letters Patent are hereby corrected as shown below:

On Page 1, Column 1, in the name of the assignee, change "Siserugique" to -- Siderurgique -- so that the name of the assignee will read "Union Siderurgique du Nord et de l'Est de la France, Paris, France."

Signed and Sealed this

Fourteenth Day of December 1976

[SEAL]

*Attest:*

RUTH C. MASON
*Attesting Officer*

C. MARSHALL DANN
*Commissioner of Patents and Trademarks*